United States Patent [19]

Brower

[11] Patent Number: 4,754,198

[45] Date of Patent: Jun. 28, 1988

[54] FLUORESCENT LAMP BIMETAL SWITCH CONTACT ARRANGEMENT

[75] Inventor: Boyd G. Brower, Williamsport, Pa.

[73] Assignee: GTE Products Corporation, Danvers, Mass.

[21] Appl. No.: 706,912

[22] Filed: Mar. 1, 1985

Related U.S. Application Data

[63] Continuation of Ser. No. 520,863, Aug. 5, 1983, abandoned.

[51] Int. Cl.[4] ..... H01J 7/44

[52] U.S. Cl. ..... 315/73; 315/106

[58] Field of Search ..... 315/73, 74, 106, 107; 337/27, 109, 26

[56] References Cited

U.S. PATENT DOCUMENTS

| | | | |
|---|---|---|---|
| 2,280,550 | 4/1942 | Smitley | 315/73 X |
| 2,930,873 | 3/1960 | Lake et al. | 337/27 X |
| 3,679,932 | 7/1972 | Murphy | 315/106 |
| 4,156,831 | 5/1979 | Cassidy et al. | 315/73 X |
| 4,171,519 | 10/1979 | Cassidy et al. | 337/27 X |

FOREIGN PATENT DOCUMENTS

| | | | |
|---|---|---|---|
| 488272 | 11/1952 | Canada | 337/27 |
| 769797 | 3/1957 | United Kingdom | 337/27 |

*Primary Examiner*—David K. Moore
*Attorney, Agent, or Firm*—Carlo S. Bessone

[57] ABSTRACT

A fluorescent lamp includes a circuit breaker having a sealed glass envelope with a pair of electrical conductors sealed therein, and a bimetal switch of U-shape form having one leg portion attached to one of the electrical conductors and a second leg portion forming a knife-edge contact with the other electrical conductors.

6 Claims, 1 Drawing Sheet

FIG.1
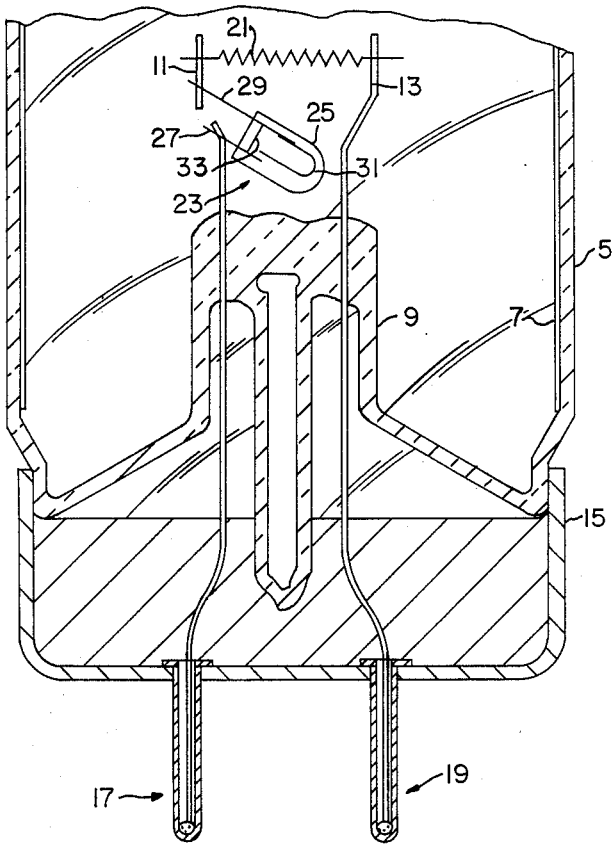
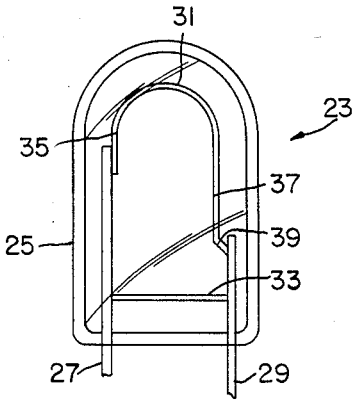
FIG.2
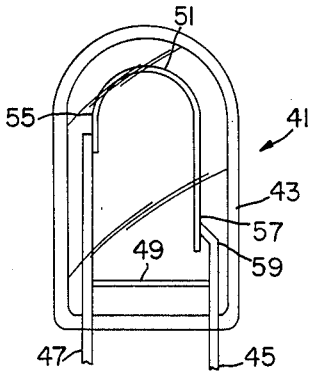
FIG.3

FLUORESCENT LAMP BIMETAL SWITCH CONTACT ARRANGEMENT

This application is a continuation of application Ser. No. 520,863, filed Aug. 5, 1983, now abandoned.

CROSS REFERENCE TO OTHER APPLICATIONS

The following concurrently-filed applications relate to rapid-start fluorescent lamps and bimetal cicruit breakers for fluorescent lamps: bearing U.S. Ser. Nos. 520,866 now abandoned; 520,865 now U.S. Pat. No. 4,528,419; and 520,862 now U.S. Pat. No. 4,656,396 respectively.

TECHNICAL FIELD

This invention relates to fluorescent lamps and more particularly to rapid-start fluorescent lamps and a circuit breaker having improved switching contact capabilities.

BACKGROUND ART

Generally, the most commonly encountered fluorescent lamps are the so calld "preheat" and "rapid-start" types of fluorescent lamp. In the "preheat" type of lamp, heater current flows through the lamp electrode during lamp ignition. Thereafter, an external voltage sensitive starter opens the electrical circuit to the lamp electrodes and heater current flow is discontinued. The "rapid-start" type of fluorescent lamp normally has a constant flow of heater current through each electrode not only during ignition but also during operation of the lamp. However, heater current flow during operation, as in the "rapid-start" lamp, is lost power which undesirably reduces the operational efficiency of the lamp.

Numerous suggestions have been made for enhancing the efficiency of "rapid-start" type fluorescent lamps. For example, U.S. Pat. Nos. 4,052,687; 4,097,779; 4,114,968; 4,156,831 and 4,171,519 which are all assigned to the Assignee of the present application, provide numerous configurations for enhanced operation of "rapid-start" type fluorescent lamps. Primarily, each provides a thermally responsive circuit breaker suitable for discontinuing heater current during operation of the fluorescent lamp.

Unfortunately, it has been found that problems still exist in spite of the enhanced advantages of the above-mentioned configurations. More specfically, it has been found that contact resistance of the electrical conductors of the circuit breaker configuration utilized in a rapdi-start fluorescent lamp is a continuing but eratic area of problems. For example, the Dumet electrical conductors usually employed in such structures tend to oxidize in varying degrees during the process of sealing the glass envelopes of the circuit breaker structures. Thus, oxides on the electrical conductors not only inhibit good electrical contact between the conductor and the bimetal of a circuit breaker but also are deleterious to the attainment of accurate low voltage resistance measurements. In other words, good electrical contact to the electrical conductors external to the circuit breaker enclosed within a glass bottle is difficult to obtain because of the oxides developed thereon during the sealing of the glass bottle.

OBJECTS AND SUMMARY OF THE INVENTION

An object of the present invention is to provide an enhanced circuit breaker. another object of the invention is to provide an enhanced "rapid-start" fluorescent lamp. Still another object of the invention is to increase the efficiency of a "rapid-start" fluorescent lamp by reducing the variations in opening and closing temperatures of an integral switch contact.

These and other objects, advantages and capabilities are achievéd in one aspect of the invention by a circuit breaker for a fluorescent lamp wherein a pair of electrical conductors are sealed into and pass through a glass bottle, a meltable by-pass element shunts the electrical conductors within the glass bottle and a thermal sensitive switch within the glass bottle is formed into a U-shaped configuration with a first leg portion attached to one of the electrical conductors and a second leg portion bent into edge contact with the other electrical conductor.

BRIEF DESCRIPTION OF THE DRAWINGS

FIG. 1 is a elevational view, partly in section, of one end of a rapid-start fluorescent lamp having a circuit breaker of the invention therein;

FIG. 2 is a cross sectional view of one embodiment of a circuit breaker suitable for use in a fluorescent lamp; and FIG. 3 is a cross sectional view of an alternate embodiment of a circuit breaker suitable for use in a fluorescent lamp.

BEST MODE FOR CARRYING OUT THE INVENTION

For a better understanding of the present invention, together with other and further objects, advantages and capabilities thereof, refrence is made to the following disclosure and appended claims in conjunction with the accompnaying drawings.

Referring to FIG. 1 of the drawings, a rapid-start fluorescent lamp includes an elongated glass envelope 5 having a coating of phosphors 7 on the inner wall surface of the envelope 5. A glass stem member 9 is sealed into the end of the envelope 5 and includes a pair of electrical leads 11 and 13 sealed therein and passing therethrough. An end cap 15 is telescoped over and attached to the end of the glass envelope 5 and includes a pair of pins 17 and 19 electrically connected to a portion of the electrical leads 11 and 13 and formed to provide electrical connection to an external source (not shown). Moreover, the envelope 5 has a gas fill therein selected from the group consisting of argon, krypton, neon, helium and combinations thereof.

An electrode 21 is located within the envelope 5 and connected at opposite ends to the electrical leads 11 and 13. Thus, the longitudinal axis of the electrode 21 is in a direction substantially normal to the direction of the electrical leads 11 and 13. Moreover, this electrode 21, which is frequently referred to as a filament or cathode, is of a well known type used in rapid start fluorescent lamps and usually includes a tungsten coil having a coating thereon in the form of alkaline earth oxides which were applied in the form of carbonates and processed to provide the oxides.

Disposed within the envelope 5 is a circuit breaker 23. The circuit breaker 23 is preferably in the form of a glass bottle 25 having a press seal at one end thereof. A pair of electrical conductors 27 and 29 are sealed into and pass through the press seal of the glass bottle 25. Also, a thermally-sensitive bimetal 31 is positioned within the glass bottle 25 with one end thereof attached to one of the electrical conductors 27 and the opposite end of the bimetal 31 contacting the other electrical conductor 29. Further, a conductive by-pass element 33, which is meltable in response to a short-duration high voltage pulse potential, shunts the bimetal 31 and is electrically connected to the electrical conductors 27 and 29. Moreover, the electrical conductors 27 and 29 extending outwardly of the glass bottle 25 are connected to the base pin 17 and to the electrical lead 11 respectively with the electrical lead 11 also connected to one end of the electrode 21.

Referring more specifically to the circuit breaker 23, FIG. 2 provides an embodiment wherein the sealed glass bottle 25 includes the pair of electrical conductors 27 and 29 sealed therein and passing therethrough. A meltable by-pass element 33 short-circuits the electrical conductors 27 and 29 within the glass bottle 25. Also, a bimetal switch member 31 is disposed within the glass bottle 25 and formed to provide a U-shaped configuration having first and second leg portions, 35 and 37 respectively.

The first leg portion 35 is attached to one of the electrical conductors 27, as by welding for example. the second leg portion 37 has a bend 39 near the end thereof to provide a knife-edge contact between the bent portion 39 and the other electrical conductor 29. Preferably, the bent portion 39 is at an angle of about 45° and forms a knife-edge contact with the electrical conductor 29 wherein all of the spring force of the bimetal 31 is concentrated at the contact point.

Alternately, FIG. 3 illustrates a circuit breaker 41 having a sealed glass bottle 43 with a pair of electrical conductors 45 and 47 sealed therein and passing therethrough. A meltable by-pass element 49 is located with the glass bottle 43 short-circuiting the pair of electrical conductors 45 and 47. A bimetal switch 51 is formed in a substantially U-shaped configuration with first and second leg portions, 55 and 57 respectively.

The first leg portion 55 is attached to one of the electrical conductors 47, preferably by welding. The other electrical conductors 45 has a bent portion 59 near the end thereof and this end portion 59 serves to provide a knife-edge contact with the second leg portion 57 of the bimetal switch 51. Also, the bent portion 59 is preferably at an angle of about 45° to insure the above-mentioned desired knife-edge contact with the second leg portion 57 whereby the entire spring force of the bimetal switch 51 is utilized to provide the desired electrical contact between the second leg portion 57 and the bent portion 59 of the electrical conductor 45.

It may be noted that tests with prior circuit breaker configurations wherein knife-edge contact was not achieved showed a variation in opening temperature of the bimetal switch in the range of over 15° C. However, tests on circuit breakers having the above-described knife-edge contact capability have shown a variation in opening temperature of the bimetal switch of less than 5° C. Moreover, the above-disclosed structures have been shown to be less sensitive to surface oxide formation of the electrical conductors and bimetal surfaces.

While there has been shown and described what is at present considered the preferred embodiments of the invention, it will be obvious to those skilled in the art that various modifications and changes may be made therein without departing from the invention as defined by the appended claims.

What is claimed is:

1. a circuit breaker for use in a rapid-start fluorescent lamp comprising:

a sealed glass bottle;

a pair of electrical conductors sealed into and passing through said sealed glass bottle;

a meltable by-pass element disposed within said glass bottle short-circuiting said pair of electrical conductors; and a thermal sensitive bimetal switch located within said glass bottle, said bimetal switch having first and second leg portions with said first leg portion being attached to one of said pair of electrical conductors and said second leg portion and said other one of said pair of electrical conductors being formed to provide a knife-edge contact therebetween.

2. The circuit breaker of claim 1 wherein said second leg portion has a bend of about 45° near the end thereof to provide a knife-edge contact with said other one of said pair of electrical conductors.

3. The circuit breaker of claim 1 wherein said other one of said pair of electrical conductors has a bend of about 45° near the end thereof to provide a knife-edge contact between said bent portion of said electrical conductors and said second leg portion of said bimetal switch.

4. A rapid-start fluorescent lamp comprising a glass envelope having a phosphor-coated inner wall surface, a pair of spaced electrodes located within said envelope, a pair of electrically conductive leads sealed into and passing through said envelope with at least one of said pair of electrically conductive leads connected to one of said pair of spaced electrodes and at least one circuit breaker disposed within said envelope, said circuit breaker including a sealed glass bottle, a pair of electrical conductors sealed therein and passing therethrough with one of said pair of electrical conductors attached to one of said pair of spaced electrodes and the other one of said pair of electrical conductors coupled tot he other one of said pair of electrically conductive leads and a thermal-sensitive bimetal switch within said glass bottle, said bimetal switch having a bimetal with first and second leg portions with said first leg portion attached to one of said pair of electrical conductors and said second leg portion and the other one of said pair of electrical conductors formed for knife-edge contact therebetween.

5. The rapid-start fluorescent lamp of claim 4 wherein said second leg portion of said bimetal is bent at an angle of 45° near the end thereof to provide a knife-edge contact between said bent portion of said bimetal and said other one of said electrical conductors.

6. The rapid-start fluorescent lamp of claim 4 wherein said other one of said pair of electrical conductors has a bend therein of about 45° near the end thereof and said end thereof provides a knife-edge contact with said second leg portion of said U-shaped bimetal switch.

* * * * *